US007051491B2

(12) United States Patent
Wohlgemuth et al.

(10) Patent No.: US 7,051,491 B2
(45) Date of Patent: May 30, 2006

(54) METHOD AND APPARATUS FOR CAPPING BOTTLES

(75) Inventors: Emanuel E. Wohlgemuth, Condado, PR (US); William Michael Rebstock, Glenburnie, MD (US)

(73) Assignee: Ultraseal Technologies Corporation, Worcester, MA (US)

( * ) Notice: Subject to any disclaimer, the term of this patent is extended or adjusted under 35 U.S.C. 154(b) by 213 days.

(21) Appl. No.: 10/123,659

(22) Filed: Apr. 15, 2002

(65) Prior Publication Data

US 2002/0152728 A1 Oct. 24, 2002

Related U.S. Application Data

(60) Provisional application No. 60/284,030, filed on Apr. 16, 2001.

(51) Int. Cl.
*B65B 7/28* (2006.01)

(52) U.S. Cl. ..... 53/366; 53/281; 53/316; 53/329

(58) Field of Classification Search ..... 53/331.5, 53/410, 471, 485, 130.1, 137.1, 272, 276, 53/281, 317, 315, 316, 329; 83/684
See application file for complete search history.

(56) References Cited

U.S. PATENT DOCUMENTS

| | | | | |
|---|---|---|---|---|
| 5,012,630 | A | 5/1991 | Ingram et al. | |
| 5,437,140 | A | 8/1995 | Molinaro | |
| 5,473,855 | A | 12/1995 | Hidding et al. | |
| 5,775,528 | A | 7/1998 | Wohlgemuth et al. | |
| 5,816,029 | A * | 10/1998 | Sweeny | 53/490 |
| 6,598,378 | B1 * | 7/2003 | Pottier | 53/556 |

* cited by examiner

*Primary Examiner*—John Paradiso

(74) *Attorney, Agent, or Firm*—Hoffmann & Baron, LLP

(57) ABSTRACT

A method and apparatus for capping blown containers is provided. The top surfaces of a snap-on cap are preferably engaged sequentially by pressure members that traverse different segments thereof. The pressure members urge the cap over the neck of a container as they traverse the cap. The pressure members are preferably mounted to a support that is positioned above an initially loosely capped container, and resiliently urge the cap in a downward direction. The pressure exerted by each pressure member on the cap may be adjustable. The surfaces of the pressure members for engaging the cap are preferably substantially spherical.

30 Claims, 6 Drawing Sheets

METHOD AND APPARATUS FOR CAPPING BOTTLES

CROSS REFERENCE TO RELATED APPLICATION

The present application claims the benefit of U.S. Provisional Patent Application Ser. No. 60/284,030 filed Apr. 16, 2001.

BACKGROUND OF THE INVENTION

1. Field of the Invention

The field of the invention relates to methods for capping bottles and bottle capping devices.

2. Brief Description of the Related Art

Blown containers or bottles are in widespread use for many purposes. Such containers are often employed to store milk, juice, water and other liquids. Neck finishes of different types are formed on blown containers to accommodate various types of closures or caps. Some containers have threaded neck portions. Application of caps to such containers is accomplished in some cases by rotating a threaded cap relative to the container. U.S. Pat. No. 5,473,855 discloses a system of this type. Some threaded caps and associated neck finishes are designed such that the caps can be applied to the bottle neck portion by downward pressure on the caps. Such caps are sometimes referred to as snap-on, screw-off caps. In order to effect a satisfactory seal, some of these caps must be rotated slightly following application. U.S. Pat. No. 5,437,140 discloses a system which applies a final tightening rotation to a push on cap. Some snap-on, screw-off caps can be simply pushed on a threaded neck portion to form a leak-proof seal without having to be rotated. U.S. Pat. No. 5,775,528 discloses such a cap and neck portion. Another type of cap is often referred to as a snap-on, snap-off cap. Such a cap is not threaded, nor is the container neck portion to which it is secured. Such caps are simply pushed on the neck portions by known capping equipment. Caps as described above are often provided with annular valve members which are intended to engage the interior portion of the neck to provide a seal. The cap must be properly secured to the neck portion for the seal to be effective.

SUMMARY OF THE INVENTION

The present invention concerns a method of applying a push-on cap to a neck portion of a container in order to provide sealing and closure. Such caps include threaded and unthreaded snap-on caps as described above. The invention also concerns an assembly for securing a cap to a neck portion of a container such as a blown container.

The assembly for mounting a cap to the neck finish of a container includes a support and one or more applicators for engaging the top surface of the cap. At least one applicator is provided which includes structure for resiliently exerting a pressure member against the top surface of a cap. The pressure member preferably includes a substantially spherical surface. A spring or other appropriate mechanism urges the pressure member towards the cap, and resists displacement of the pressure member away from the cap. The spring pressure may be adjustable by appropriate means. In operation, the support member is positioned over a cap, and the applicator(s) engage(s) different portions of the top surface of the cap. The cap is thereby pushed onto the neck portion of the container to reliably effect closure and sealing. The applicator(s) help ensure that the cap will be applied to the neck portion without misalignment. Sequential engagement of a plurality of applicators is preferred. An effective seal is accordingly formed using a procedure and assembly that are easily employed in automated bottling plants.

The method according to the invention involves the resilient and preferably sequential application of pressure to various parts of the top surface of a cap, thereby urging it downwardly over the neck finish of a blown container.

DETAILED DESCRIPTION OF THE INVENTION

Figure 1:
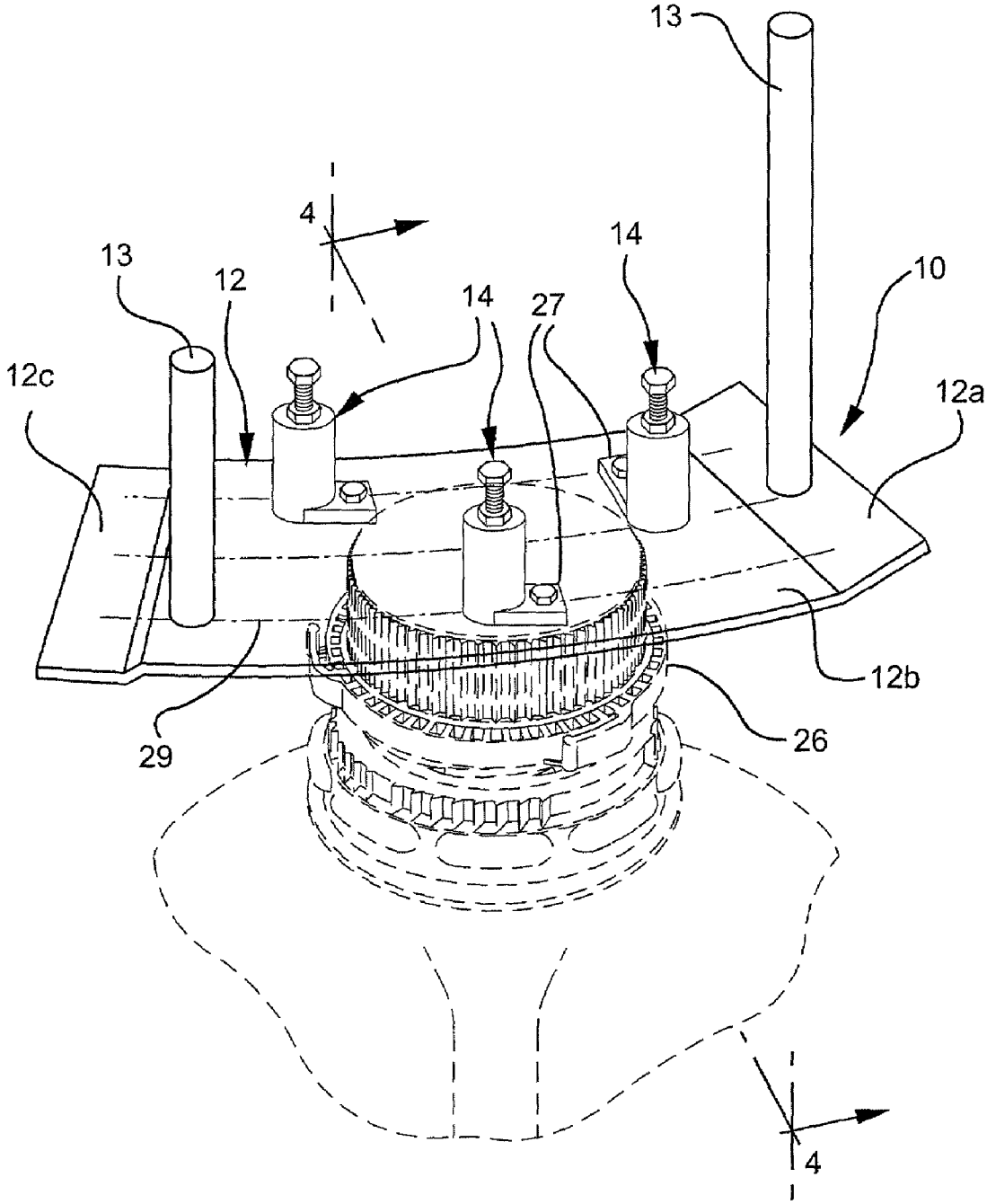
FIG. 1 is a top perspective view of a capping assembly in accordance with the invention.

There is shown in the drawings and described below in detail a preferred embodiment of the invention with the understanding that the present disclosure is to be considered as exemplary of the principles of the invention and is not intended to limit the invention to the embodiment illustrated.

Figure 2:
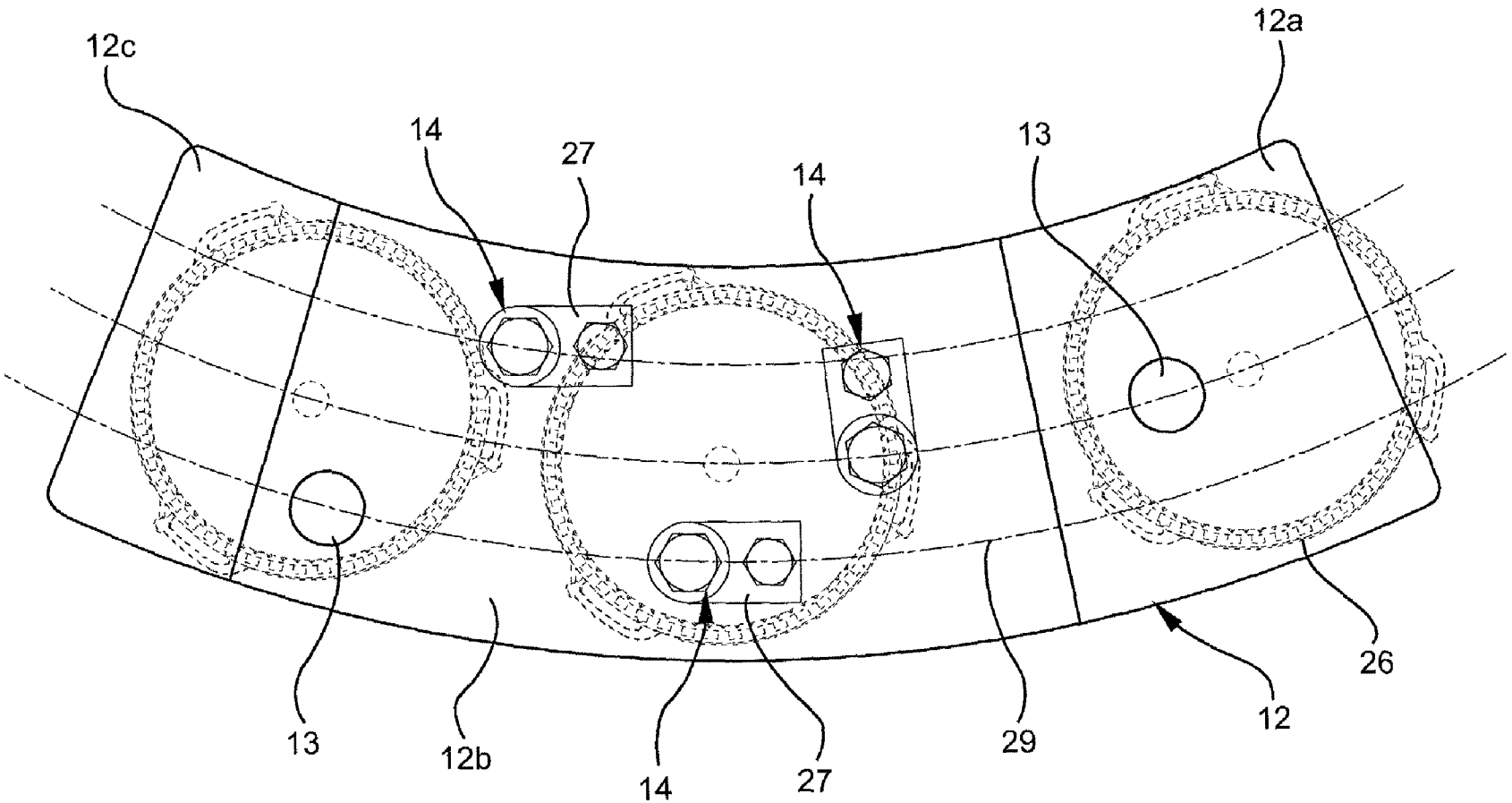
FIG. 2 is a top plan view thereof.
Figure 3:
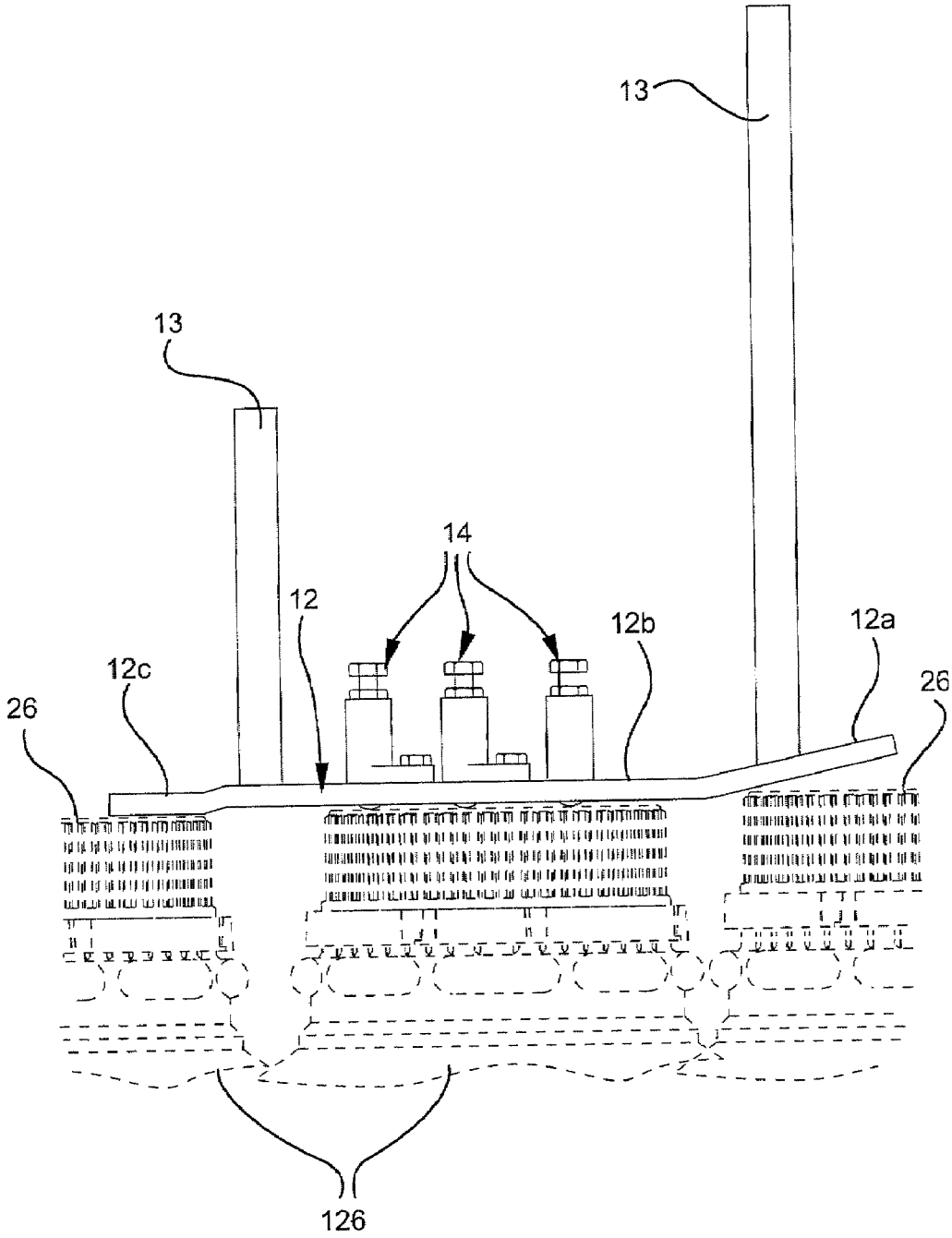
FIG. 3 is a side elevation view thereof.

Referring to FIG. 1, an assembly 10 is provided for engaging closures or caps and pushing them onto the neck finishes of containers such as blown plastic bottles. The assembly includes a support 12 and one or more applicators 14 mounted to the support. The support is in the form of a plate which may be made from stainless steel and have a thickness of about a quarter of an inch. The applicators are mounted to a flat portion of the support. The support shown in the drawings includes an upwardly curved end portion 12A, a flat central portion 12B, and a flat end portion 12C on a lower plane than the central portion, as shown in FIG. 3. The support is generally arcuate as shown in the top view of FIG. 2. Posts 13 extend through openings in the support and allow height adjustment. It will be appreciated that the configuration of the support and the positioning of the applicator(s) may be different depending on the design of the capping station in which they are used.

Figure 4:
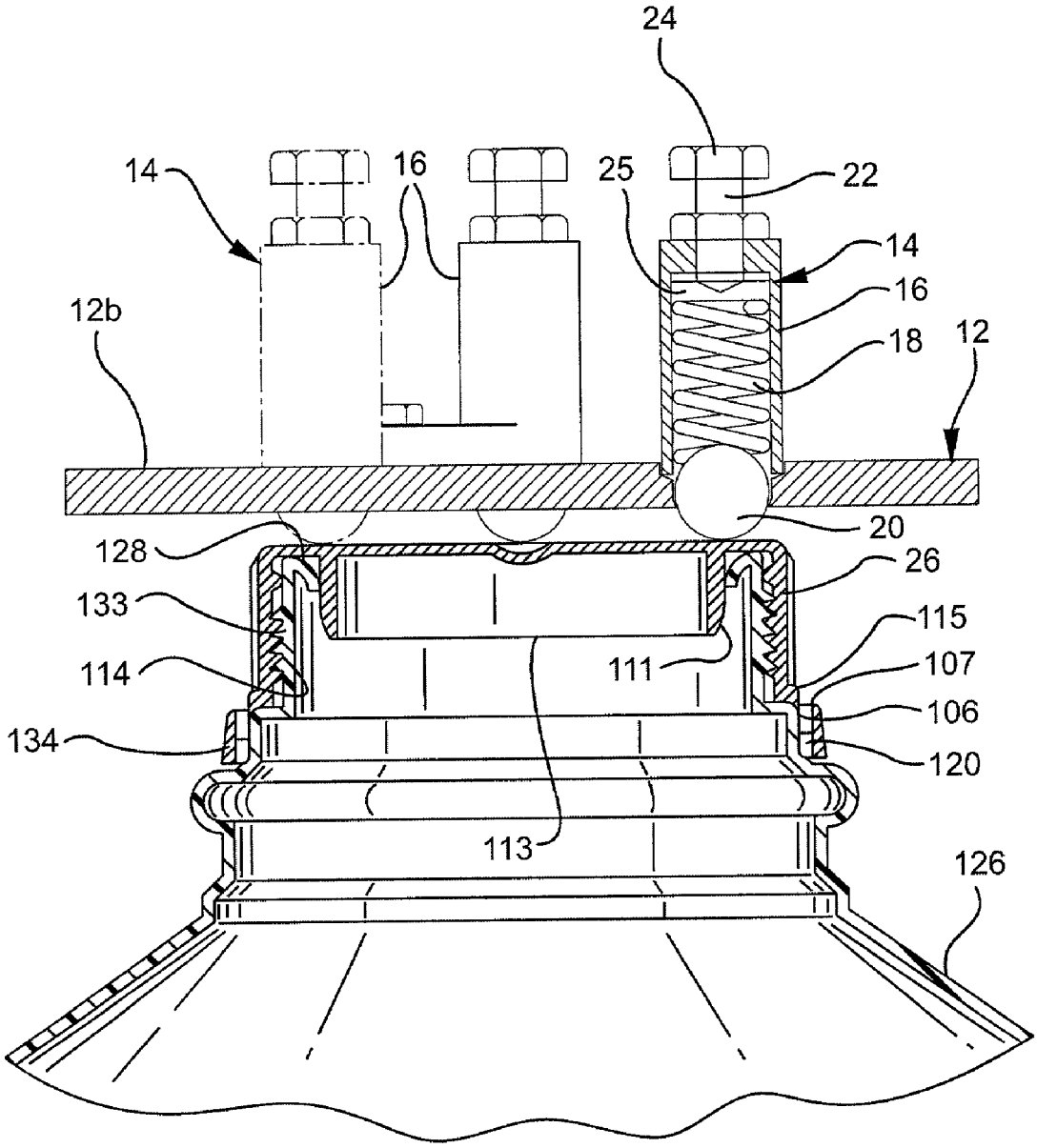
FIG. 4 is a sectional view thereof taken along line 4—4 of FIG. 1.
Figure 5:
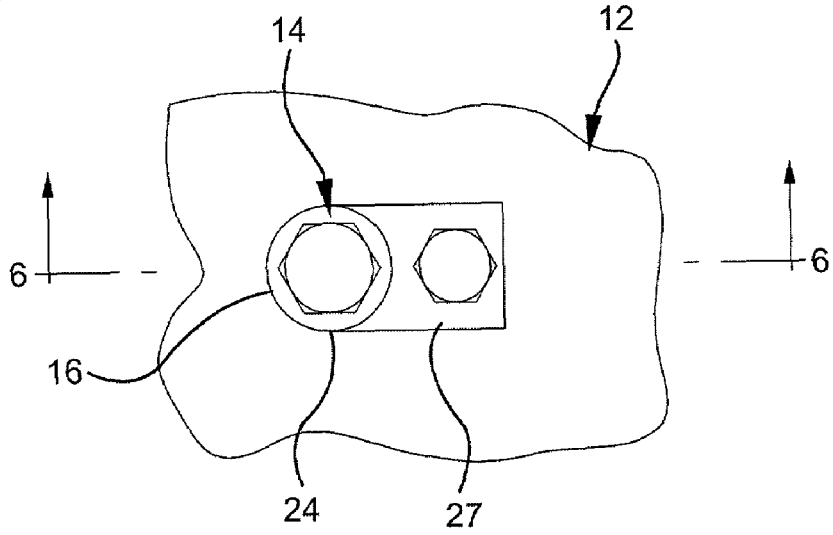
FIG. 5 is a top plan view of an applicator and associated bracket.
Figure 6:
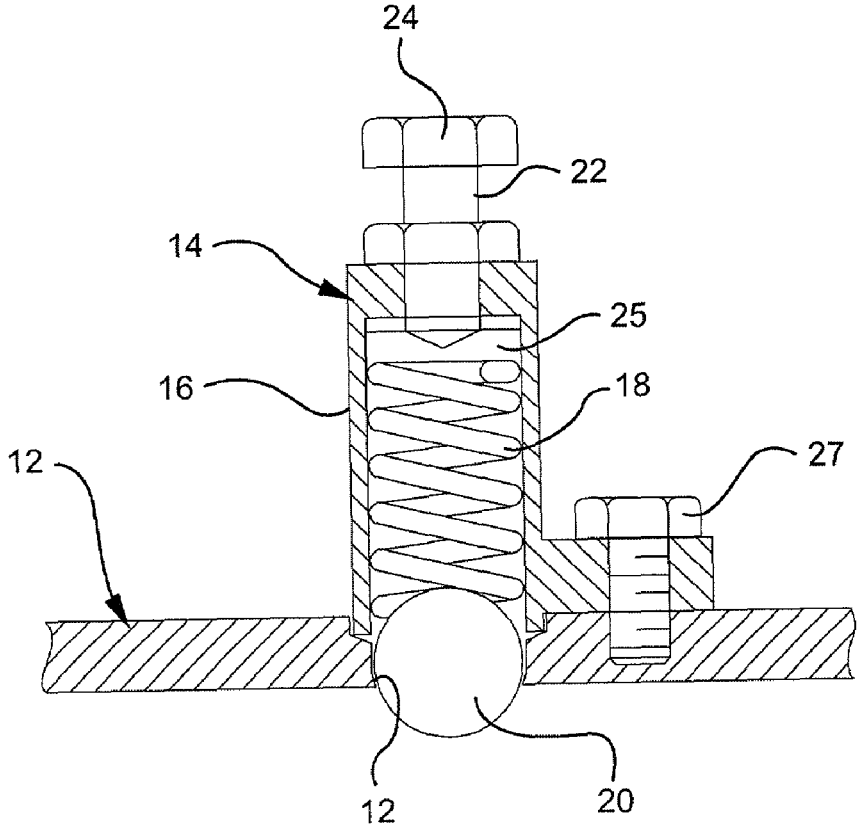
FIG. 6 is a sectional view taken along line 6—6 of FIG. 5.

Each of the three applicators employed in the preferred embodiment of the invention is identical in construction. The number of applicators and their construction may vary for various types of equipment and caps. The three applicators are in a triangular configuration for applying pressure to three different portions of the top wall of the cap. As shown in FIG. 4, each applicator includes a cylindrical housing 16 that includes an internally threaded lock nut at the upper end thereof. The ends of each housing 16 are open. A coil spring 18 is positioned within each housing. A pressure member 20, such as a ball bearing or other preferably spherical member, is positioned within each housing and partially extends through the opening at the bottom end of the housing. The support may be include openings 21 that are dimensioned to retain the ball bearing or other such pressure member, as shown in FIG. 6. The upper end of each opening 21 is adapted to receive an end of the housing 16.

(One of the openings in FIG. 3. is shown without an accompanying applicator for illustrative purposes.) A threaded stud 22 is coupled to the top end of the housing. An adjustment knob 24 is mounted to the stud. One end of the spring 18 is engageable with a spring guide 25 while the other end is engageable with the pressure member. Rotation of the stud causes it and the spring guide to move towards or away from the pressure member. The force exerted on the pressure member in the direction of the cap can accordingly be varied by an operator. (In an alternative embodiment that is not shown, the force exerted on the pressure member is preset and cannot be adjusted. An opening in the housing is preferably provided in such an embodiment to facilitate cleaning the housing interior and the spring if necessary.) Other means for resiliently urging the pressure member, such as an elastomeric insert (not shown), could be employed in place of the coil spring 18.

The support may include as few as one applicator. Brackets 27 may be used to mount each applicator to the support 12. There is no known maximum number of applicators, but more than three would be unlikely to be necessary for most bottling operations. Where more than one applicator is used, the spherical end surfaces thereof are preferably arranged such that they will engage the top surface of a cap sequentially. When three applicators are used, one is positioned to traverse the central portion of the top surface. In other words, it substantially bisects the top surface of the cap. The other two applicators are positioned over the outer edge of the path 29 of the annular valve member of the cap, as shown in FIG. 2.

In use, filled containers 126 and caps 26 are provided to a capping station. The caps are positioned upon the neck portions of the containers in a known manner. The filled containers are moved with respect to the applicators such that the caps are engaged sequentially by the applicators, causing the caps to be locked in place by complementary locking features and/or threads 133,114 on the containers and caps. If the cap is of the type including a lower skirt 106 connected to the cap body 115 by a tear line 107, as disclosed in U.S. Pat. No. 5,775,528, the lugs 120 of the lower skirt are moved into position between ratchet teeth (not shown) on the collar portion 134 of the container. The annular valve members 113 of the caps will also be in sealing engagement with the neck portions. The applicator(s) interact with each cap as it is seated to promote reliability in closure and sealing. The force exerted by the spring(s) is preferably such that, in normal operation, the pressure member(s) maintain contact with the top surface of the cap as it is moved with respect to the neck finish.

In the embodiment shown in FIG. 1, containers pass under the support 12 such that one applicator 14 is the first to engage each cap. This applicator maintains contact with the top surface of each cap and preferably traverses the center portion thereof. A second applicator then engages the cap, and traverses a segment on one side of the first applicator. The third applicator is the last to engage the cap, and traverses a segment on the other side of the first applicator. The sequential application of pressure along different segments of the cap moves the cap downwardly over the neck finish in a reliable manner, and causes the valve member 113 to form a reliable seal with the container rim 128 as shown in FIG. 4. The valve member may include an exterior taper 111 formed on the valve body 113. The resilient application of pressure, the spherical surfaces of the pressure members, and the ability of the pressure members to rotate enhance the performance of the assembly. The upwardly extending leading end 12A of the support initially applies pressure to the cap without fully sealing it. The trailing end 12C is also positioned for engaging the top surface of the cap and urge it downwardly over the neck finish if necessary.

Figure 7:
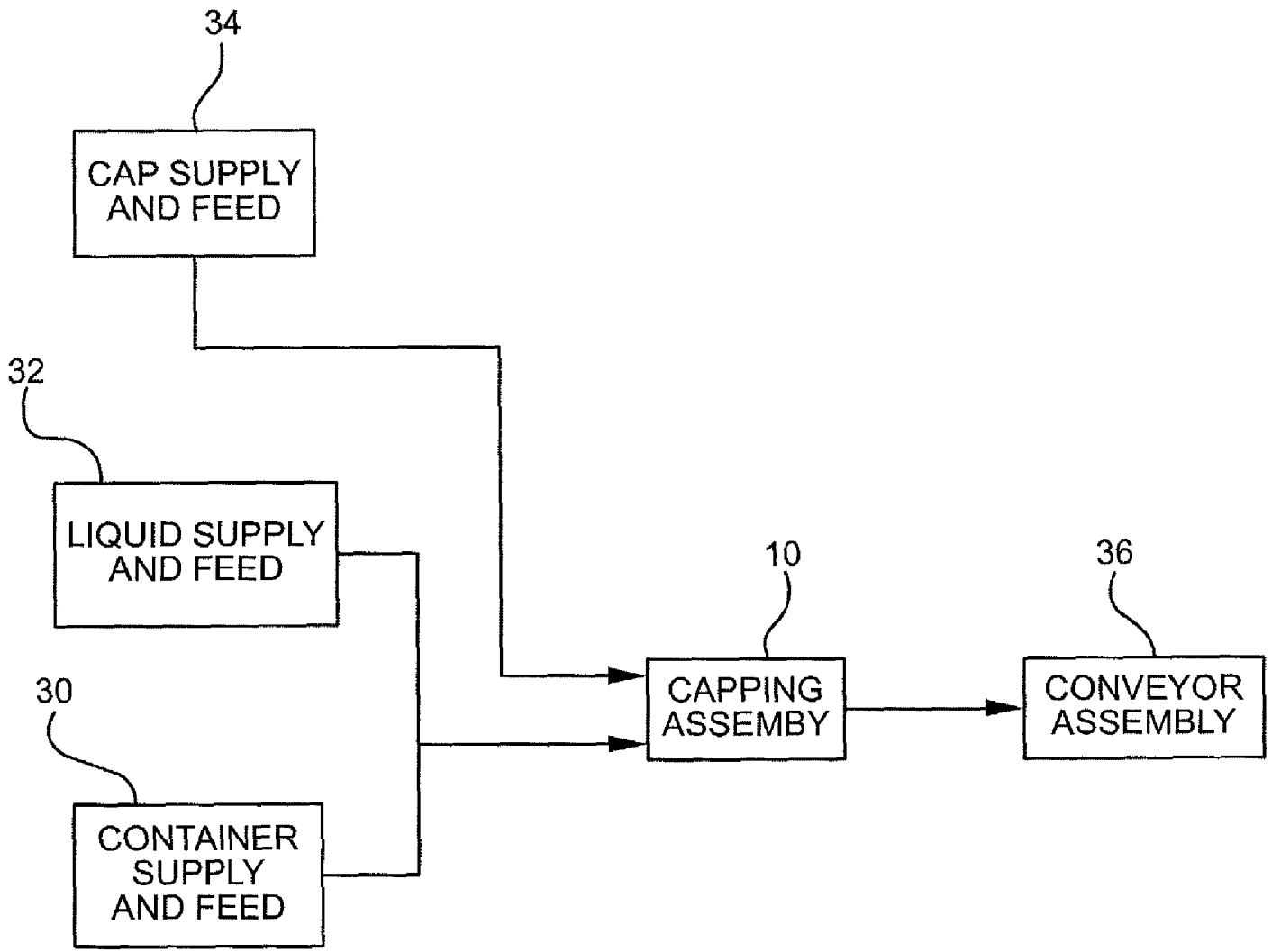
FIG. 7 is a schematic illustration of a system for filling and capping containers.

The method and apparatus described above are usable with various types of caps and complementary neck portions, including threaded and unthreaded caps. It is particularly applicable to the application of plastic caps to blown plastic bottles. A system for filling and capping blown bottles is shown in FIG. 7. A container supply and feed 30 provides containers from either storage or a blow molding assembly (not shown). The containers are filled with liquid from a liquid supply and feed 32. A cap supply and feed 34 provides caps to the capping assembly 10 where they are applied to the neck portions of the containers. The filled, capped containers travel beneath the support 12 in the capping assembly 10 on a conveyor assembly 36. Prior to engagement of the caps by leading end 12A of the support and the pressure members 20, the caps are loosely positioned on the container neck portions. The pressure member of the centrally located applicator is preferably the first to engage the cap, and moves across the center portion of the top surface of the cap while applying downward pressure thereto. It accordingly seats the front and back portions of the valve member. The pressure member of the second applicator is the next to engage the top surface of the cap, and travels along a side portion thereof substantially parallel to the path of the first pressure member. The pressure member of the third applicator then engages the top surface of the cap and travels along another side portion thereof and parallel to the path of the first pressure member. The second and third pressure members are preferably positioned over the outer edges of the path 29 of the cap valve member 113. While the initial engagement of each pressure member in the preferred embodiment is sequential, it will be appreciated that more than one pressure member will engage the top surface of a cap at various times. The sequential pushing of the cap over the neck portion of the container causes it to move over the retention elements of the neck finish, such as threads and/or rib(s). As the cap includes a plug or valve member for sealingly engaging the rim of the neck finish, it is important for the cap to seat properly. The applicators help ensure such seating.

It will be appreciated that various modifications can be made to the apparatus and method described above without departing from the spirit of the invention.

What is claimed is:

1. An assembly for applying a push on cap to a container comprising:

a conveyor for transporting containers;

a support positioned above said conveyor;

one or more applicators mounted to the support, each applicator including a pressure member having a downwardly extending end that includes a substantially spherical end surface for traversing the top surface of a cap on a container as the container is transported by the conveyor, and means for resiliently urging said one or more of the pressure members in a downward direction.

2. An assembly as described in claim 1, wherein each applicator includes a housing, the pressure member being positioned in said housing such that said substantially spherical end surface extends outside said housing and beneath said support.

3. An assembly as described in claim 2, wherein said means for resiliently urging said one or more pressure members includes a spring, said spring being positioned within said housing, and said one or more pressure member is a sphere.

4. An assembly as described in claim 3 including means for varying the force exerted by said spring on said one or more pressure member.

5. An assembly as described in claim 1 including means for varying the force exerted by said means for resiliently urging.

6. An assembly as described in claim 1 including a plurality of pressure members mounted to said support, the end surfaces of said pressure members being positioned such that they are sequentially engageable with a top surface of a cap.

7. An assembly as described in claim 6 including first, second and third pressure members mounted to said support in triangular orientation.

8. An assembly as described in claim 1 wherein said pressure member is rotatably mounted with respect to said support.

9. An assembly as described in claim 1 wherein said support includes an upwardly inclined leading end portion.

10. A capping station for applying a push-on cap to a container comprising:

means for providing containers having neck portions;

means for providing caps for the neck portions of said containers;

means for positioning said caps on the neck portions of said containers;

a plurality of pressure members;

means for moving the containers beneath said pressure members such that said pressure members sequentially traverse and sequentially apply downward pressure to each cap.

11. A capping station as described in claim 10 including a support and a plurality of applicators mounted to said support, each applicator including one of said pressure members.

12. A capping station as described in claim 10 including a support and at least three pressure members mounted to said support, said pressure members being in a triangular configuration.

13. A capping station as described in claim 10 including means for resiliently urging said pressure members towards the containers.

14. A capping station as described in claim 10 wherein each of said pressure members includes a substantially spherical surface for engaging caps.

15. A capping station as described in claim 10 including means for adjusting the force exerted by said pressure members on the caps.

16. A capping station as described in claim 11, wherein each applicator includes a housing, a spring positioned in said housing, said pressure member positioned in said housing, said spring exerting a force on said pressure member.

17. A capping station as described in claim 10 including a support, each of said pressure members being rotatably mounted to said support.

18. A capping station as described in claim 17 wherein said support includes an upwardly inclined leading end.

19. A capping station as described in claim 18 wherein said support includes a central portion and a trailing end portion, said trailing end portion having a bottom surface on a lower plane than the bottom surface of said central portion.

20. An apparatus for applying a push on cap to a container wherein the cap is of the type including a top surface, a skirt extending downwardly from the top surface, and an annular valve member extending downwardly from the top surface and within the skirt, and the container is of the type having a neck portion including a rim, comprising:

means for applying a cap to the neck portion of a container such that the skirt of the cap extends over the rim;

first means for applying pressure to a first portion of the top surface of the cap;

second means for applying pressure to a second portion of the top surface of the cap;

third means for applying pressure to a third portion of the top surface of the cap;

said first, second and third means being positioned to provide pressure sequentially to the cap as the container traverses a path beneath them.

21. An apparatus as described in claim 20 including a support having an upwardly inclined leading end and a flat portion adjoining said lending end, said first, second and third means for applying pressure being mounted to said support.

22. An apparatus as described in claim 21 wherein said support includes a trailing end extending beneath said flat portion.

23. An apparatus as described in claim 20 wherein each of said means for applying pressure includes a pressure member having a substantially spherical surface end portion for engaging the cap.

24. An apparatus as described in claim 23 wherein each of said means for applying pressure includes a spring engaging said pressure member.

25. An apparatus as described in claim 23 including means for moving containers beneath said first, second and third means for applying pressure.

26. An apparatus for applying a push-on cap to a neck portion of a container, comprising:

means for positioning a cap on the neck portion of a container;

means for sequentially engaging the cap with a plurality of pressure members; and means for moving a container relative to said pressure members such that said pressure members traverse different portions of the cap while sequentially applying pressure to the cap and pushing the cap over the neck portion of the container.

27. An apparatus as described in claim 26 including means for resiliently urging each of said pressure members.

28. An apparatus as described in claim 27 wherein each of said pressure members include a substantially spherical end surface for engaging a cap.

29. An apparatus as described in claim 28 wherein at least one of said pressure members is comprised of a spherical ball, and means for rotatably supporting each of said at least one of said pressure members.

30. An apparatus as described in claim 28 including a support, said pressure members being mounted to said support, said support including a bottom surface portion for applying pressure to a cap.

* * * * *

UNITED STATES PATENT AND TRADEMARK OFFICE

CERTIFICATE OF CORRECTION

PATENT NO. : 7,051,491 B2
APPLICATION NO. : 10/123659
DATED : May 30, 2006
INVENTOR(S) : Wohlgemuth et al.

It is certified that error appears in the above-identified patent and that said Letters Patent is hereby corrected as shown below:

Column 6, Line 21: now reads "portion adjoining said lending end"
should read -- portion adjoining said leading end --

Signed and Sealed this

Twenty-eighth Day of August, 2007

JON W. DUDAS
*Director of the United States Patent and Trademark Office*